US008264313B2

(12) United States Patent
Sasao et al.

(10) Patent No.: US 8,264,313 B2
(45) Date of Patent: Sep. 11, 2012

(54) LINEAR SOLENOID FOR VEHICLE

(75) Inventors: Kazuhiro Sasao, Kariya (JP); Akinori Hirano, Nagoya (JP)

(73) Assignee: Denso Corporation, Kariya (JP)

( * ) Notice: Subject to any disclaimer, the term of this patent is extended or adjusted under 35 U.S.C. 154(b) by 113 days.

(21) Appl. No.: 12/974,377

(22) Filed: Dec. 21, 2010

(65) Prior Publication Data

US 2011/0148555 A1 Jun. 23, 2011

(30) Foreign Application Priority Data

Dec. 22, 2009 (JP) ..... 2009-290604

(51) Int. Cl.
*H01F 5/00* (2006.01)
*H01F 27/04* (2006.01)

(52) U.S. Cl. ..... 335/282; 335/278; 335/281; 336/107

(58) Field of Classification Search ..... 335/278, 335/281, 282; 336/107
See application file for complete search history.

(56) References Cited

U.S. PATENT DOCUMENTS 5,153,550 A * 10/1992 Sugiura et al. ..... 336/192
2004/0212473 A1 10/2004 Iwazaki et al.
2004/0233025 A1 11/2004 Kon et al.
2006/0022546 A1 2/2006 Kon et al.
2006/0243938 A1 11/2006 Ishibashi et al.

FOREIGN PATENT DOCUMENTS

| | | |
|---|---|---|
| JP | H02-024515 U | 2/1990 |
| JP | 06-333730 | 12/1994 |
| JP | 08-152076 | 6/1996 |
| JP | 2000-154883 | 6/2000 |
| JP | 2000-205432 | 7/2000 |
| JP | 2004-144230 | 5/2004 |
| JP | 2004-301294 | 10/2004 |
| JP | P2004-297871 A | 10/2004 |
| JP | P2004-327673 A | 11/2004 |
| JP | 2006-165203 | 6/2006 |
| JP | 2006-342863 | 12/2006 |
| JP | 2008-099531 | 4/2008 |
| JP | 2008-111490 | 5/2008 |

OTHER PUBLICATIONS

Japanese Office Action dated Sep. 13, 2011, issued in corresponding Japanese Application No. 2009-290604 with English Translation.

* cited by examiner

*Primary Examiner* — Ramon Barrera
(74) *Attorney, Agent, or Firm* — Nixon & Vanderhye PC

(57) ABSTRACT

A guide of a coil device has a tongue portion, which is formed by resin integrally with the guide at a location radially outward of a slit of a yoke and axially extends toward an opening part of the yoke such that a distal end part of the tongue portion is resiliently bendable while exerting a resilient force. The tongue portion is resiliently engaged with a flange portion of a stator core upon filling of the coil device to the stator core.

4 Claims, 7 Drawing Sheets

LINEAR SOLENOID FOR VEHICLE

CROSS REFERENCE TO RELATED APPLICATION

This application is based on and incorporates herein by reference Japanese Patent Application No. 2009-290604 filed on Dec. 22, 2009.

BACKGROUND OF THE INVENTION

1. Field of the Invention

The present invention relates to a linear solenoid for a vehicle.

2. Description of Related Art

A solenoid control valve is installed as a solenoid device in a vehicle to control, for example, a hydraulic automatic transmission. A linear solenoid plays an important role in the solenoid control valve.

This kind of linear solenoid is disclosed in, for instance, Japanese Unexamined Patent Publication No. 2006-307984A (corresponding to US 2006/0243938A1) and will be described with reference to FIG. 9. An exemplary solenoid hydraulic pressure control valve for an automatic transmission will be described with reference to FIG. 9. The hydraulic pressure control valve of FIG. 9 includes a spool valve 101 and a linear solenoid 102. The linear solenoid 102 drives the spool valve 101.

The linear solenoid 102 includes a coil device 110, a plunger 120 and a magnetic stator 130. The coil device 110 is configured into a tubular form and receives a solenoid coil 112*b*. The plunger 120 is electromagnetically driven by the coil device 110. The magnetic stator 130 forms a magnetic circuit, which drives the plunger 120. The magnetic stator 130 includes a yoke 131 and a stator core 135. The yoke 131 covers an outer peripheral surface of the coil device 110. The magnetic stator 130 receives the plunger 120 in an axially slidable manner.

A control device 200 controls the current value of the electric current supplied to the coil device 110 in a variable manner to axially drive the plunger 120, so that the valve position of the spool valve 101 is changed.

The electric power supply from the control device 200 to the coil device 110 is implemented by inserting an electrical conductor cord 200*a*, which extends from the control device 200, into pin type terminals 110*a*, which are insert molded in the coil device 110.

In general, the coil device 110 is assembled as follows. That is, the coil device 110 is fitted over the stator core 135 of the magnetic stator 130, which is in turn inserted into the cup shaped yoke 131. Then, an opening of the yoke 131 is fixed to a casing (fixing member) of the spool valve 101.

Therefore, the coil device 110 and the stator core 135 need to be loosely fitted together due to the required manufacturing tolerances and/or the assembling tolerances, which limit interference between the coil device 110 and the stator core 135.

With respect to the above described type of the linear solenoid, besides the above cord type, there has been also proposed a rigid type electrical connection between the linear solenoid and the control device. In the case of the rigid type electrical connection, each of the terminals is configured into a strip form, and these terminals are directly connected together. However, in the case of the rigid electrical connection, it has been believed that a robust electrical connection can be implemented. However, when the terminals are worn after a long time use, a contact failure may occur at the electrical connection between the terminals.

Through various experiments and studies for the above disadvantage, it has been found that a gap, which is formed between the coil device 110 and the stator core 135, causes a resonance phenomenon of the coil device 110, thereby resulting in the above disadvantage. Particularly, an axial length of the linear solenoid 102 is unavoidably lengthened due to its need for axially driving the plunger 120. Therefore, under severe driving conditions, such as driving of the vehicle on a rough dirt road for a long period of time, the resonance phenomenon discussed above may cause damage to the terminals and/or unintended disconnection between the terminals in the worst case, thereby possibly resulting in an uncontrollable state of the linear solenoid 102.

In the case of the rigid type electrical connection, in view of the above disadvantage, it has been proposed to provide a vibration absorbing or dumping function to the terminals. However, such a function has not been implemented for practical use.

In the case of the cord type electrical connection using the cord 200*a*, due to the flexibility of the cord 200*a*, the cord 200*a* can absorb or dump the vibrations of the coil device 110. However, the cord 200*a* may possibly be unexpectedly disconnected due to the above resonance phenomenon. Thereby, it is necessary to provide countermeasures for the above disadvantage in view of a reliability of the electrical connection.

SUMMARY OF THE INVENTION

The present invention addresses the above disadvantages. According to the present invention, there is provided a linear solenoid for vehicle, including a coil device, a plunger, a magnetic stator and means for fixing the coil device and the magnetic stator with each other. The coil device includes a coil main body and a guide. The coil main body is configured into a tubular form and receives a solenoid coil therein. The guide projects from an outer peripheral surface of the coil main body and has at least one terminal, through which an electric power is supplied from an external device to the solenoid coil at time of energizing the solenoid coil. The coil device is substantially entirely covered with resin except the at least one terminal. The plunger is electromagnetically driven by the coil device. The magnetic stator forms a magnetic circuit to drive the plunger. The magnetic stator includes a stator core and a yoke. The stator core receives the plunger in a slidable manner along an inner peripheral surface of the stator core. The coil device is fitted to an outer peripheral surface of the stator core. The yoke is configured into a cup form and receives the stator core together with the coil device and has a slit, which extends from an opening end part toward a bottom part of the yoke to limit interference between the yoke and the guide. The means for fixing the coil device and the magnetic stator with each other is implemented through use of a resilient force, which is exerted from the resin at a location between the coil device and the magnetic stator.

DETAILED DESCRIPTION OF THE INVENTION (First Embodiment)

Figure 1:
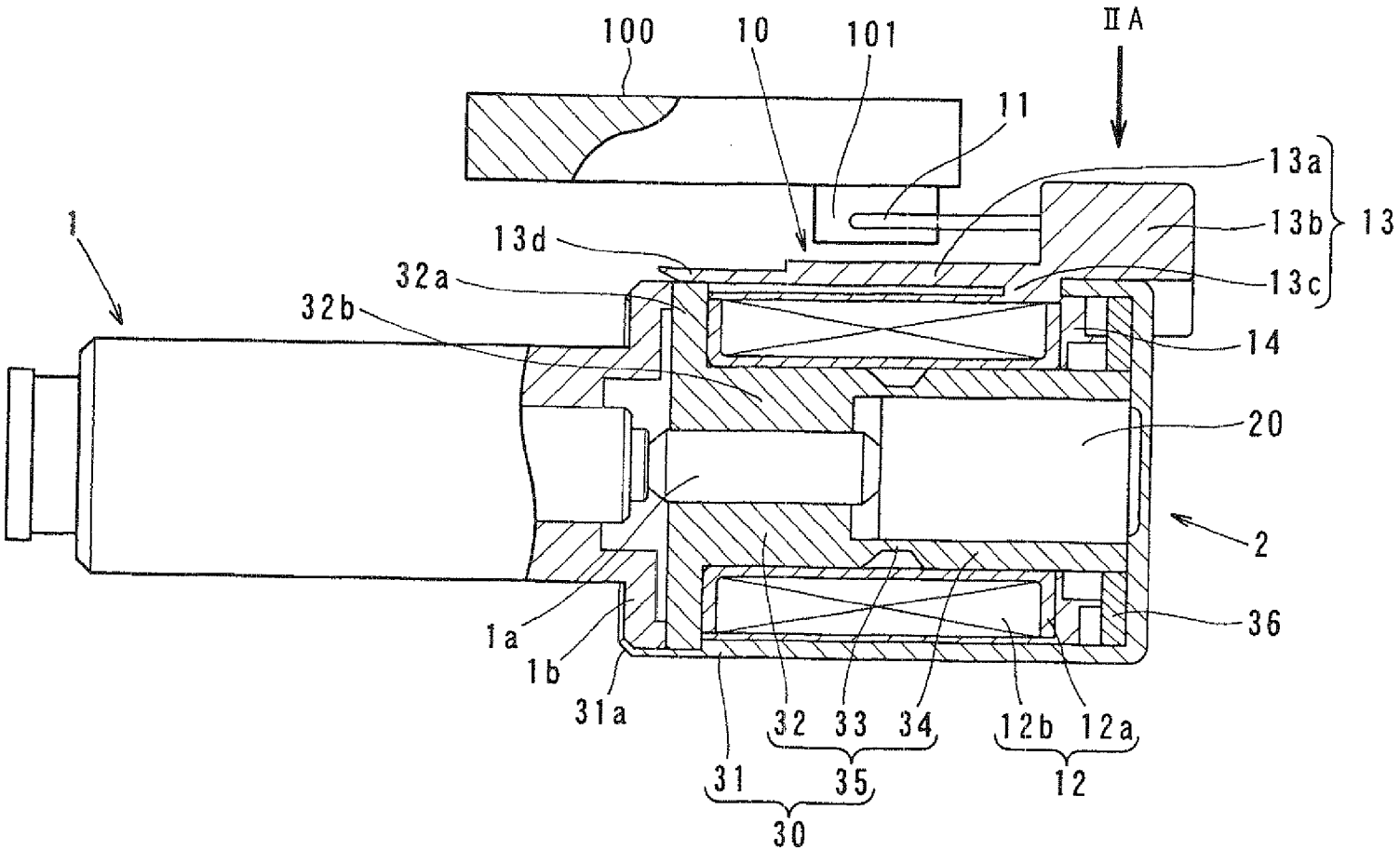
FIG. 1 is a partially fragmented view of a solenoid hydraulic pressure control valve according to a first embodiment of the present invention.
Figure 2A:
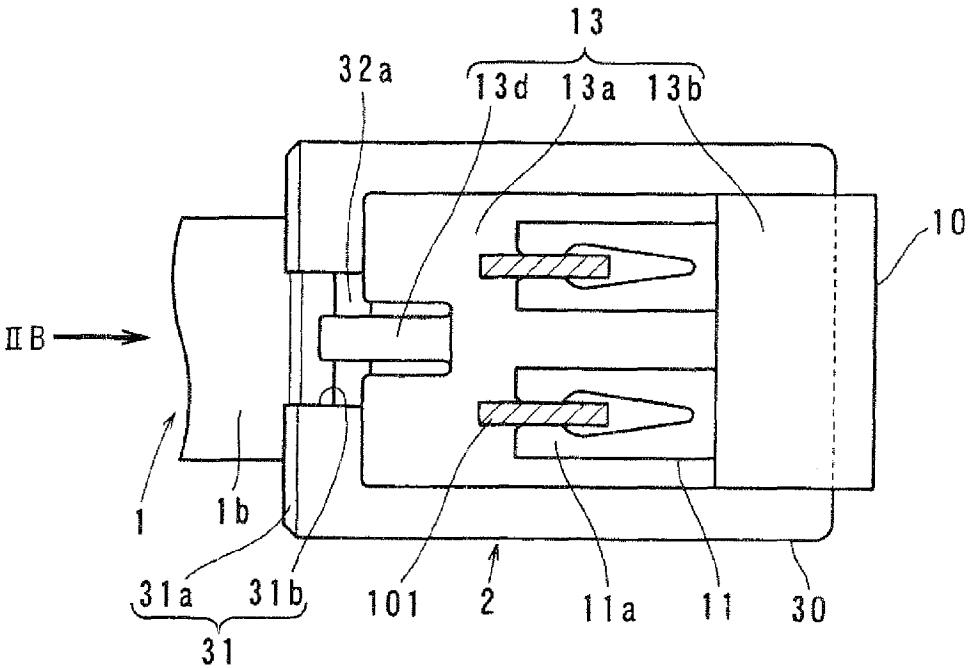
FIG. 2A is a partial view taken in a direction of an arrow IIA in FIG. 1.
Figure 2B:
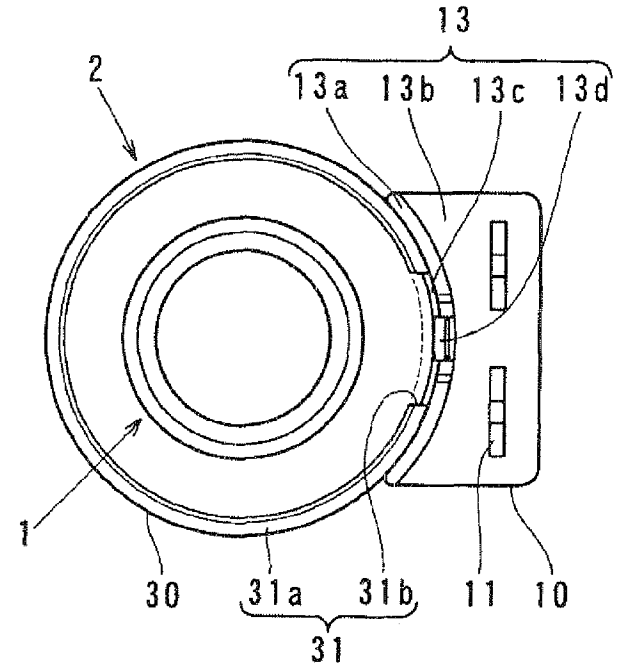
FIG. 2B is a view taken in a direction of an arrow IIB in FIG. 2A, showing a state before electrically connecting terminals of a linear solenoid shown in FIG. 2A.

FIGS. 1 to 2B show a solenoid hydraulic pressure control valve of an automatic transmission of a vehicle according to a first embodiment of the present invention. The hydraulic pressure control valve is installed in an engine room of the vehicle or at a lower part of a body of the vehicle and includes a spool valve 1 and a linear solenoid 2. The spool valve 1 controls a hydraulic pressure. The linear solenoid 2 drives the spool valve 1 based on an output of a control device (external device) 100.

The linear solenoid 2 includes a coil device 10, a plunger 20 and a magnetic stator 30. The coil device 10 drives the plunger 20. The magnetic stator 30 forms a magnetic circuit, which drives the plunger 20. Two terminals 11 project from an outer surface of the coil device 10. The terminals 11 receive an electric power from output terminals 101 of the control device 100 and serve as external device connection terminals.

The coil device 10 generates a magnetic force upon energization thereof to form a loop of a magnetic flux, which passes through the plunger 20 and the magnetic stator 30. As shown in FIG, 3, the coil device 10 is configured into a cylindrical tubular form and includes a coil main body 12 and a guide 13. The coil main body 12 receives a solenoid coil 12*b* described below. The guide 13 projects from an outer peripheral surface of the coil main body 12 and is configured into a saddle form.

The coil main body 12 is formed as follows. That is, an insulated wire of the solenoid coil 12*b* is wound around a bobbin 12*a*, which is made of thermosetting resin (e.g., PPS). Then, this intermediate assembly is molded along with the terminals 11 with thermosetting resin (e.g., PPS), which forms a molded resin portion (hereinafter, simply referred to as resin portion) 14, in an insert molding process (postforming). At the time of molding, the guide 13 is also integrally formed.

An inner peripheral surface of the bobbin 12*a* is exposed from the resin portion 14 to directly form an inner peripheral surface of the coil device 10. Furthermore, the terminals 11 are electrically connected to two ends, respectively, of the wire of the solenoid coil 12*b* before the molding process of the resin portion 14.

Therefore, the coil device 10 is substantially entirely covered with the resin (the bobbin 12*a* and the resin portion 14) except the terminals 11.

Figure 3:
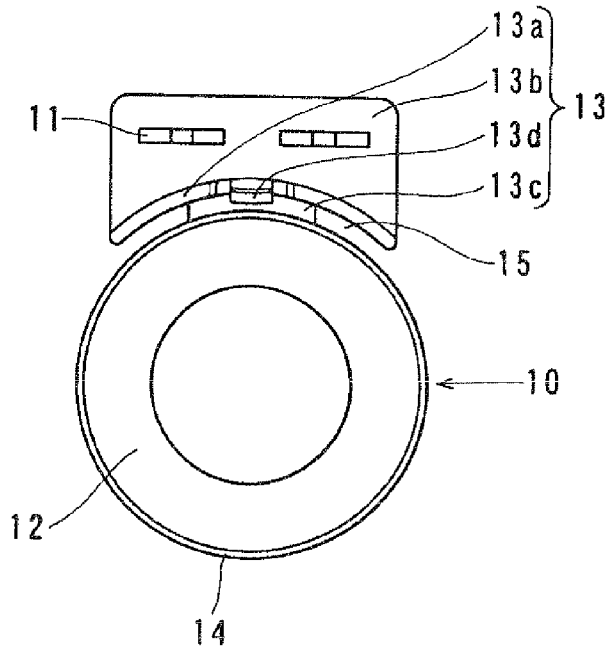
FIG. 3 is a front end view seen from the left side in FIG. 1 before an assembling process of a coil device.

Particularly, with reference to FIG. 3, the guide 13 includes a thin wall portion 13*a*, a thick wall portion 13*b* and a neck portion 13*c*. The guide 13 is connected to, i.e., joined to an outer peripheral surface of the coil main body 12 through the neck portion 13*c*. The thin wall portion 13*a* is configured into a wing form (canopy form). Specifically, the thin wall portion 13*a* circumferentially extends along the outer peripheral surface of the coil main body 12. Furthermore, a radial gap 15, which corresponds to a radial wall thickness of a yoke 31 described later (i.e., the radial gap 15 being generally equal to or slightly larger than the radial wall thickness of the yoke 31), is radially defined between the outer peripheral wall surface of the coil main body 12 and an inner peripheral surface of the thin wall portion 13*a*. A circumferential center part of the thin wall portion 13*a* is radially inwardly recessed from the rest of the thin wall portion 13*a* such that an inner peripheral surface of the circumferential center part of the thin wall portion 13*a* is placed radially inward of an outer peripheral surface of a flange portion of the stator core 35 (specifically, a flange portion 32*a* of a magnetically attracting core 32). In other words, a radial distance, which is measured from the central axis of the stator core 35 to the inner peripheral surface of the circumferential center part of the thin wall portion 13*a*, is smaller than a radial distance, which is measured from the central axis of the stator core 35 to the outer peripheral surface of the flange portion 32*a*. A tongue portion 13*d*, which has a thin wall, projects at the circumferential center part of the thin wall portion 13*a* in an axial direction away from the neck portion 13*c*.

Before the assembling process described later, the tongue portion 13*d* projects straight from its proximal end part to its distal end part. At the assembling process, the tongue portion 13*d* is engaged with the flange portion of the stator core 35 (specifically, the flange portion 32*a* of the magnetically attracting core 32). That is, the distal end part of the tongue portion 13*d* rides on the outer peripheral surface of the flange portion 32*a* and is thereby radially outwardly warped, i.e., radially outwardly bent due to its resiliency. The tongue portion 13*d*, which is engaged with the flange portion of the stator core 35, serves as means (hereinafter, referred to as resiliently fixing means) for fixing the coil device 10 and the magnetic stator 30 with each other through use of the resilient force.

The terminals 11 axially project from the thick wall portion 13*b* and are thereby placed over the thin wall portion 13*a* at the location radially outward of the thin wall portion 13*a*.

The plunger 20 is configured into a cylindrical rod form and is made of a ferromagnetic material (e.g., iron). The plunger 20 is slidable directly along the inner peripheral surface of the magnetic stator 30 (more specifically, the inner peripheral surface of the stator core 35).

A spool valve 1 side end surface of the plunger 20 contacts a distal end part of a shaft 1*a* of the spool valve 1, and the plunger 20 is urged together with the shaft la by an urging force a spring (not shown) toward the right side in FIG. 1.

The magnetic stator 30 includes the yoke 31 and the stator core 35. The stator core 35 includes the magnetically attracting core 32, a magnetically insulating portion 33 and a slide core 34, which are formed integrally in a forging process. The yoke 31 is made of a magnetic material and is configured into a cup form to cover the outer peripheral surface of the coil device 10. The stator core 35 is inserted into the yoke 31 from a cup opening part 31*a* of the yoke 31, which serves as an opening end part of the yoke 31, and then the cup opening part 31*a* of the yoke 31 is radially inwardly swaged against a casing 1*b* of the spool valve 1, which serves as an installation portion.

Figure 4:
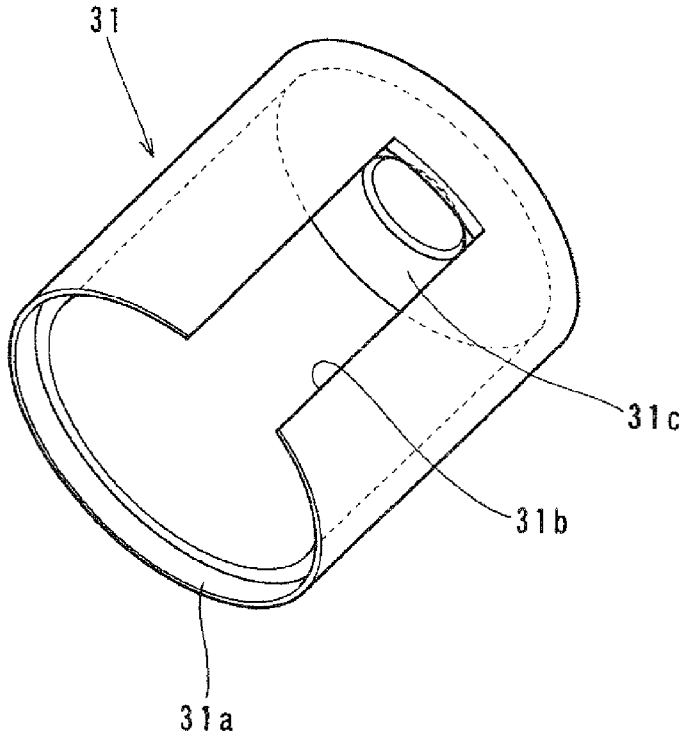
FIG. 4 is a perspective view of a yoke shown in FIG. 1.

As shown in FIG. 4, the cup opening part 31*a* of the yoke 31 forms a swaging thin wall portion, which is swaged against the casing 1 b of the spool valve 1. Furthermore, a slit (recess) 31*b* is formed to axially extend from the cup opening part 31*a* toward a cup bottom part 31*c*. The slit 31*b* limits an interference between the guide 13 of the coil device 10 and the yoke 31 at the time of installing the stator core 35 and the coil device 10 to the yoke 31.

A width (circumferential size) of the slit 31*b* is set such that the neck portion 13*c* of the guide 13 can smoothly move into the slit 31*b* without substantial interference. A length (axial length) of the slit 31*b* is set such that the installed guide 13 slightly projects in the axial direction from the cup bottom part 31*c* of the yoke 31. Furthermore, since the thin wall portion 13*a* of the guide 13 is configured into the wing form, which circumferentially extends while the radial gap 15, which corresponds to the wall thickness of the yoke 31, is provided between the outer peripheral surface of the coil main body 12 and the thin wall portion 13*a*. Therefore, the thin wall portion 13*a* can be seated on the outer peripheral surface of the yoke 31 and aids in the stable insertion of the coil device 10 into the yoke 31.

The magnetically attracting core 32 has a T-shaped cross section in the longitudinal cross section thereof and includes the flange portion 32*a* and an attracting portion 32*b*. The flange portion 32*a* is magnetically coupled with the yoke 31 through the cup opening part 31*a* of the yoke 31. The attracting portion 32*b* axially opposed to the plunger 20 and axially slidably supports the shaft 1 a. A magnetically attracting part (main magnetic gap) is formed between the attracting portion 32*b* and the plunger 20.

The casing 1*b* of the spool valve I and the flange portion 32*a* of the magnetically attracting core 32 are received at the inside of the thin wall portion of the cup opening part 31*a* of the yoke 31, and then the cup opening part 31*a* of the yoke 31 is swaged against the casing 1*b* of the spool valve 1.

The magnetically insulating portion 33 limits a direct flow of the magnetic flux between the magnetically attracting core 32 and the slide core 34 and is formed as a thin wall portion having a large magnetic reluctance.

The slide core 34 is configured into a cylindrical tubular form and surrounds around the plunger 20. The plunger 20 directly contacts the inner peripheral surface of the slide core 34 and is slidable along the inner peripheral surface of the slide core 34. In this way, the magnetic flux is conducted between the slide core 34 and the plunger 20 in the radial direction.

An auxiliary core 36, which is made of a ferromagnetic material (e.g., iron) and is configured into a ring form (annular form), is placed between the slide core 34 and the yoke 31 to enhance the magnetic coupling between the slide core 34 and the yoke 31. The auxiliary core 36 is engaged with the slide core 34 and is clamped between the coil device 10 and the yoke 31.

The terminals 11 serve as power supply terminals. Each terminal 11 is configured into an elongated strip made of an electrically conductive metal material and has a bifurcated portion 11*a*. The bifurcated portion 11 a has two resilient segments, which resiliently hold a corresponding mating terminal 101 of the control device 100 therebetween. Each of the terminals (output terminal) 101 of the control device 100 is made of an electrically conductive metal material and is configured into an elongated strip form. These terminals 101 are securely fixed to a body of the control device 100. Therefore, when the terminals 101 are held by the terminals 11, respectively, a rigid electrical connection is formed between the linear solenoid 2 and the control device 100.

Now, the background of the first embodiment will be briefly described. The coil device 10 is fitted over the stator core 35 of the magnetic stator 30, which is in turn inserted into the yoke 31 through the cup opening part 31*a*. Then, the cup opening part 31*a* of the yoke 31 is swaged against the casing 1*b* of the spool valve 1 to form the linear solenoid 2.

In the case where the stator core 35 of the magnetic stator 30, to which the coil device 10 is fitted, is installed to the yoke 31, small gaps may possibly be formed between the coil device 10 and the magnetic stator 30, particularly the stator core 35 of the magnetic stator 30 due to presence of the manufacturing tolerances of the coil device 10 and the stator core 35 and/or the assembling tolerances between the coil device 10 and the stator core 35.

The gaps may be present in both of the axial direction and the radial direction. The axial gap may be be eliminated by interposing, for example, a wave washer between the coil device 10 and the auxiliary core 36. However, it may be difficult to eliminate the radial gap.

Now, the characteristics of the first embodiment will be described. In order to address the above disadvantage, the linear solenoid 2 of the first embodiment adapts the following technique.

Specifically, in the coil device 10, the thin wall portion 13*a* of the guide 13 is configured into the wing form, which extends in the circumferential direction, and the radial gap 15, which corresponds to the radial thickness of the yoke 31, is formed between the outer peripheral surface of the coil main body 12 and the thin wall portion 13*a*. Furthermore, the tongue portion 13*d* is formed in the circumferential center part of the thin wall portion 13*a* to project in the axial direction.

Before the assembling process, the tongue portion 13*d* projects such that the distal end part of the tongue portion 13*d* is slightly radially inwardly inclined relative to the proximal end part of the tongue portion 13*d* toward the outer peripheral surface of the coil main body 12. At the assembling process, the coil main body 12 is slid over and is thereby fitted over the stator core 35 from the slide core 34 side, so that the distal end part of the tongue portion 13*d* is resiliently radially outwardly warped, i.e., bent due to its resiliency and rides on (i.e., is engaged with) the flange portion 32*a* of the magnetically attracting core 32 of the stator core 35. The distal end part of the tongue portion 13*d* has a tilted surface (see FIG. 1), which aids in the smooth riding of the tongue portion 13*d* over the flange portion 32*a*.

Thereby, the coil device 10 is urged and is fixed to the stator core 35 due to the resilient force of the tongue portion 13*d*. Thereby, the above gaps, particularly the radial gap can be substantially eliminated.

In order to increase the resilient force of the tongue portion 13*d*, the distal end part of the tongue portion 13*d* may be configured to be further radially inwardly inclined in its free state (i.e., a state where not stress is applied to the tongue portion 13*d*). Alternatively, a radial size of a part of the flange portion 32*a* of the magnetically attracting core 32, which is exposed in the slit 31*b* of the yoke 31, may be enlarged, and the distal end part of the tongue portion 13*d* may ride on, i.e., may be engaged with this enlarged part of the flange portion 32*a*.

Furthermore, as a modification, instead of using the tongue portion 13*d*, the thin wall portion 13*a* may be further axially extended such that a distal end part of the thin wall portion 13*a* is directly engageable with the flange portion of the stator core 35 (i.e., the flange portion 32*a* of the magnetically attracting core 32). That is, at the assembling process, the distal end part of the thin wall portion 13*a* may be directly fitted over the flange portion of the stator core 35 with the resilient force of the distal end part of the thin wall portion 13*a*. Furthermore, depending on a need, a projection(s) may be provided to the inner peripheral surface of the distal end part of the thin wall portion 13*a* to promote the more secure engagement of the distal end part of the thin wall portion 13*a* over the flange portion of the stator core 35.

(Second Embodiment)

Figure 5A:
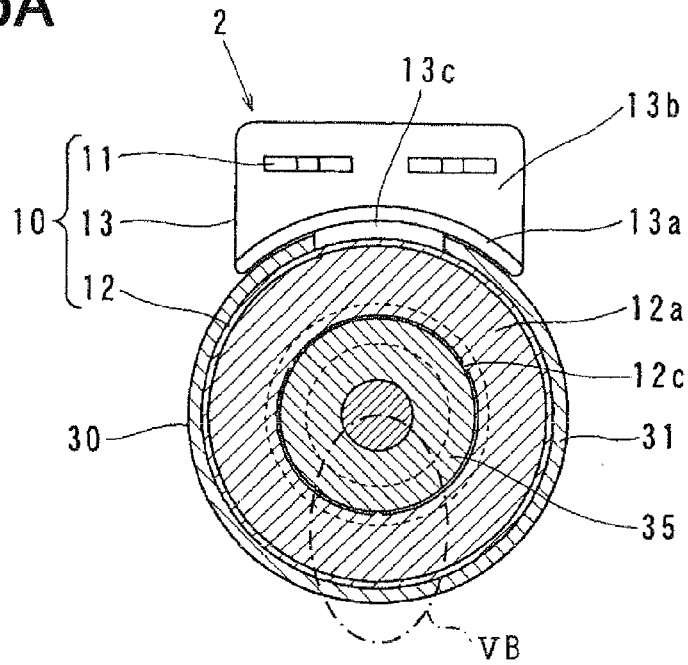
FIG. 5A is a schematic cross-sectional view of a solenoid hydraulic pressure control valve according to a second embodiment of the present invention.
Figure 5B:
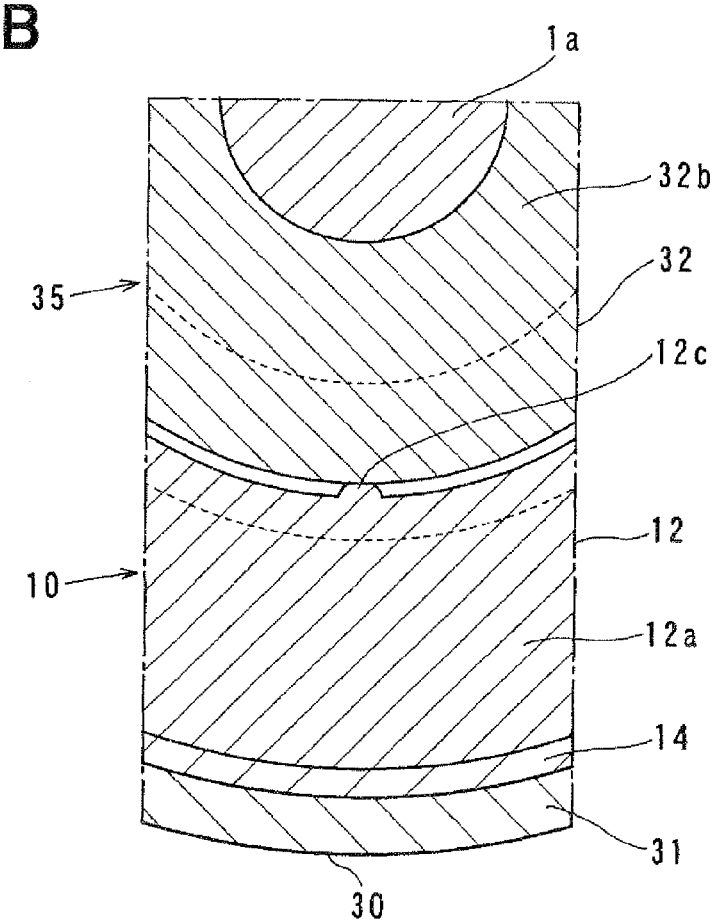
FIG. 5B is a partial enlarged view of an area VB in FIG. 5A.

FIGS. 5A and 5B schematically show a cross section of a main feature of a linear solenoid 2 according to a second embodiment of the present invention.

In the present embodiment, the bobbin 12*a* of the coil main body 12, which is made of the thermosetting resin, is effectively used to form the resiliently fixing means for fixing the coil device 10 and the magnetic stator 30 with each other through use of the resilient force. Specifically, a plurality of projections 12*c* is integrally formed in the inner peripheral surface of the bobbin 12*a*, which is exposed from the resin portion 14. The projections 12*c* extend in the axial direction along the inner peripheral surface of the bobbin 12*a*. The projections 12*c* include three projections 12*c*, which are arranged one after another at generally 120 degree intervals in the circumferential direction.

In an alternative case where the inner peripheral surface of the bobbin 12*a* is completely surrounded by the resin portion 14 through the insert molding, the projections 12*c* may be integrally formed in an inner peripheral surface of the resin portion 14.

According to the present embodiment, when the coil device 10 is fitted to the stator core 35 of the magnetic stator 30, the radial gap can be substantially eliminated by the projections 12*c*, which exert the resilient force against the attracting portion 32*b* of the magnetically attracting core 32.

According to the present embodiment, in the coil device 10, the thin wall portion 13*a* of the guide 13 is simply configured into an arcuate form, which extends along the outer peripheral surface of the yoke 31.

(Third Embodiment)

Figure 6A:
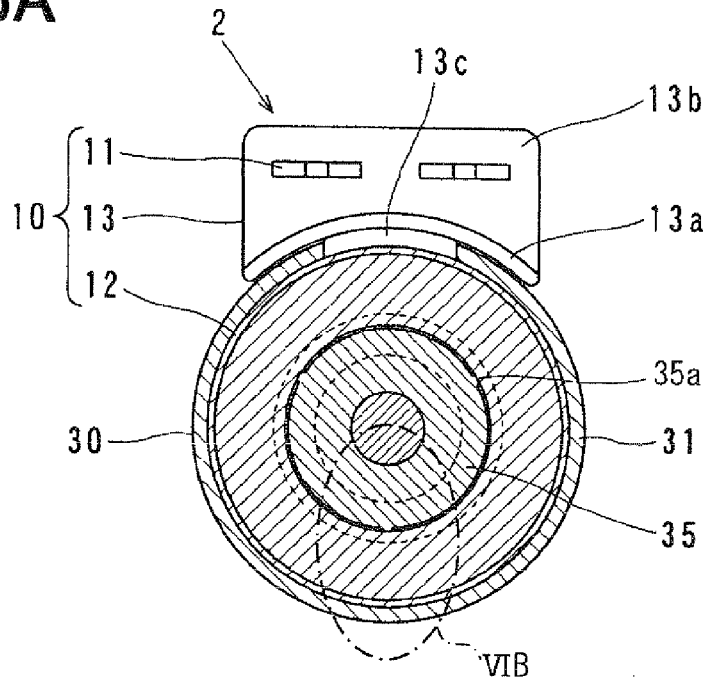
FIG. 6A is a schematic cross-sectional view of a solenoid hydraulic pressure control valve according to a third embodiment of the present invention.
Figure 6B:
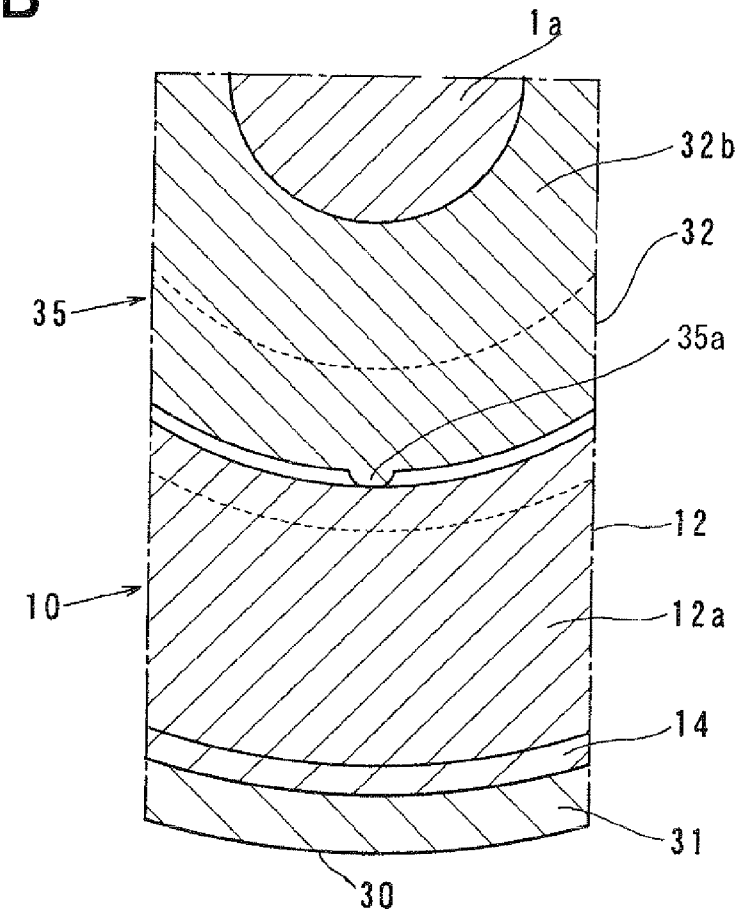
FIG. 6B is a partial enlarged view of an area VIB in FIG. 6A.

FIGS. 6A and 6B schematically show a cross section of a main feature of a linear solenoid 2 according to a third embodiment of the present invention.

In the present embodiment, as the resiliently fixing means for fixing the coil device 10 and the magnetic stator 30 with each other through use of the resilient force, a plurality of projections 35*a* is integrally formed in the outer peripheral surface of the stator core 35 of the magnetic stator 30, particularly, the outer peripheral surface of the attracting portion 32*b* of the magnetically attracting core 32. The projections 35*a* extend in the axial direction along the outer peripheral surface of the attracting portion 32*b*. Similar to the second embodiment, the projections 35*a* include three projections 35*a*, which are arranged one after another at generally 120 degree intervals in the circumferential direction.

In this embodiment, a reaction force is exerted from the inner peripheral surface of the coil device 10 (the inner peripheral surface of the bobbin 12*a* or of the resin portion 14 in the case where the inner peripheral surface of the bobbin 12*a* is covered with the resin portion 14) at the time when the projections 35*a* are urged against and bite into the inner peripheral surface of the coil device 10. This reaction force, which is exerted from the inner peripheral surface of the coil device 10, serves as the resilient force to implement the effect similar to that of the second embodiment.

Depending of a manufacturing method of the stator core 35, these projections may be modified into an appropriate manner. For instance, in a case where the entire stator core 35 is formed by a cutting process (machining process), each of these projections may be formed to extend in the circumferential direction to have a semicircular cross section rather than extending in the axial direction.

(Fourth Embodiment)

Figure 7A:
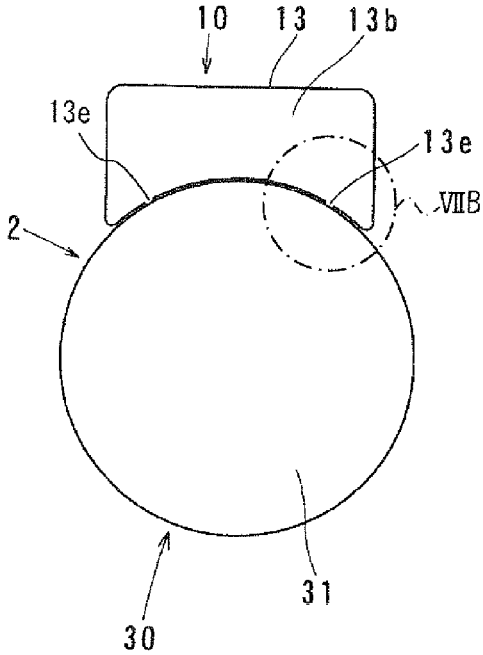
FIG. 7A is a schematic cross-sectional view of a solenoid hydraulic pressure control valve according to a fourth embodiment of the present invention.
Figure 7B:
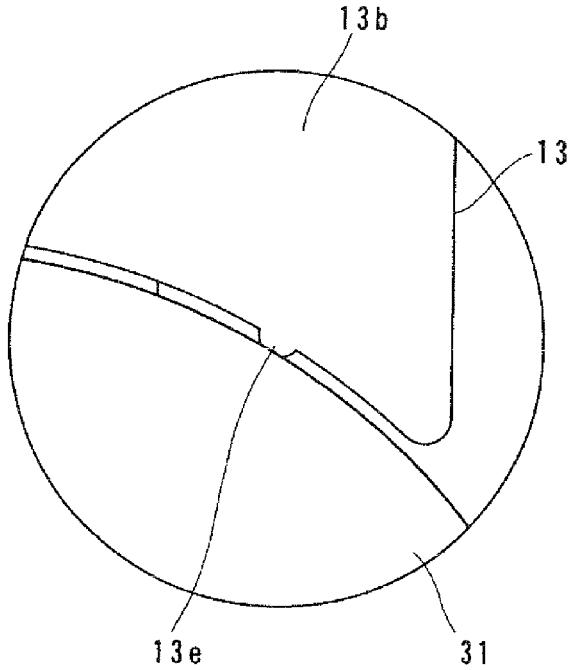
FIG. 7B is a partial enlarged view of an area VIIB in FIG. 7A.

FIGS. 7A and 7B schematically show a main feature of a linear solenoid 2 according to a fourth embodiment of the present invention, seen from a rear side (the right side in FIG. 1) of the linear solenoid 2.

In the present embodiment, a plurality of projections 13*e* is integrally formed in the inner peripheral surface of the thick wall portion 13*b* of the guide 13 and extends in the axial direction, so that the projections 13*e* serve as the resiliently fixing means for fixing the coil device 10 and the magnetic stator 30 with each other through use of the resilient force. The projections 13*e* include two projections 13*e*, which are arranged one after another at an appropriate interval in the circumferential direction.

In the present embodiment, the coil device 10 is first fitted to the stator core 35 of the magnetic stator 30. Then, when the stator core 35, to which the coil device 10 is fitted, is inserted into the yoke 31, the coil device 10 is press fitted to the yoke 31 through the guide 13, which has the projections 13*e* resiliently urged against the outer peripheral surface of the yoke 31 to exert the resilient force. In this way, the radial gap can be substantially eliminated like in the first embodiment.

If it is desirable to provide the sufficient resilient force, two additional projections 13*e* may be formed at two opposed circumferential end parts of the inner peripheral surface of the thin wall portion (configured into the wing form) 13*a* of the guide 13 shown in FIG. 6.

(Fifth Embodiment)

Figure 8A:
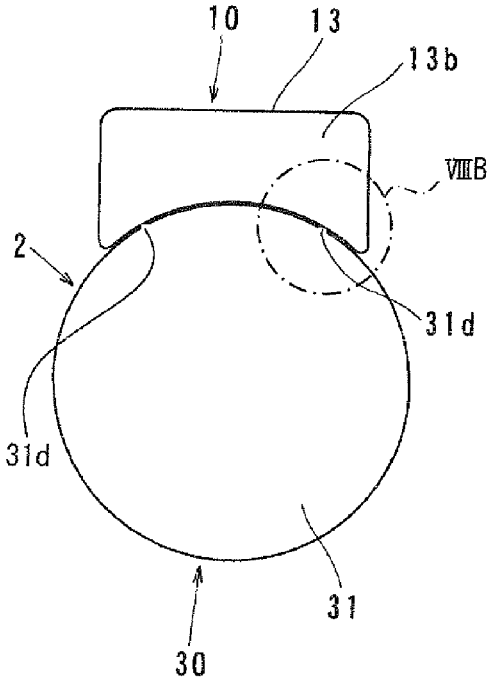
FIG. 8A is a schematic cross-sectional view of a solenoid hydraulic pressure control valve according to a fifth embodiment of the present invention.
Figure 8B:
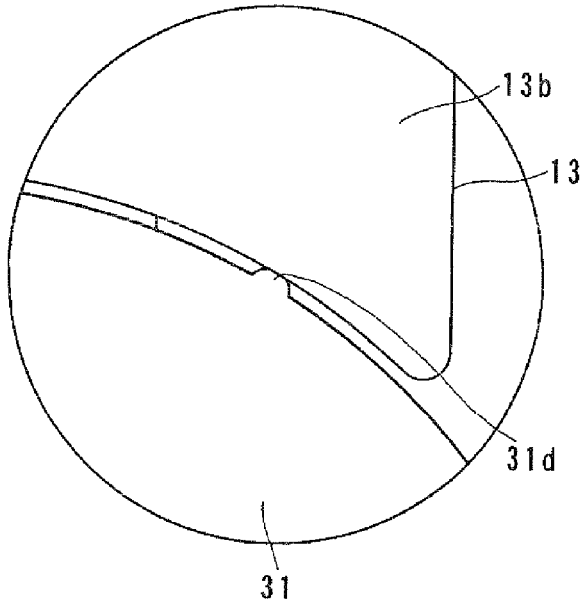
FIG. 8B is a partial enlarged view of an area VIIIB in FIG. 8A.
Figure 9:
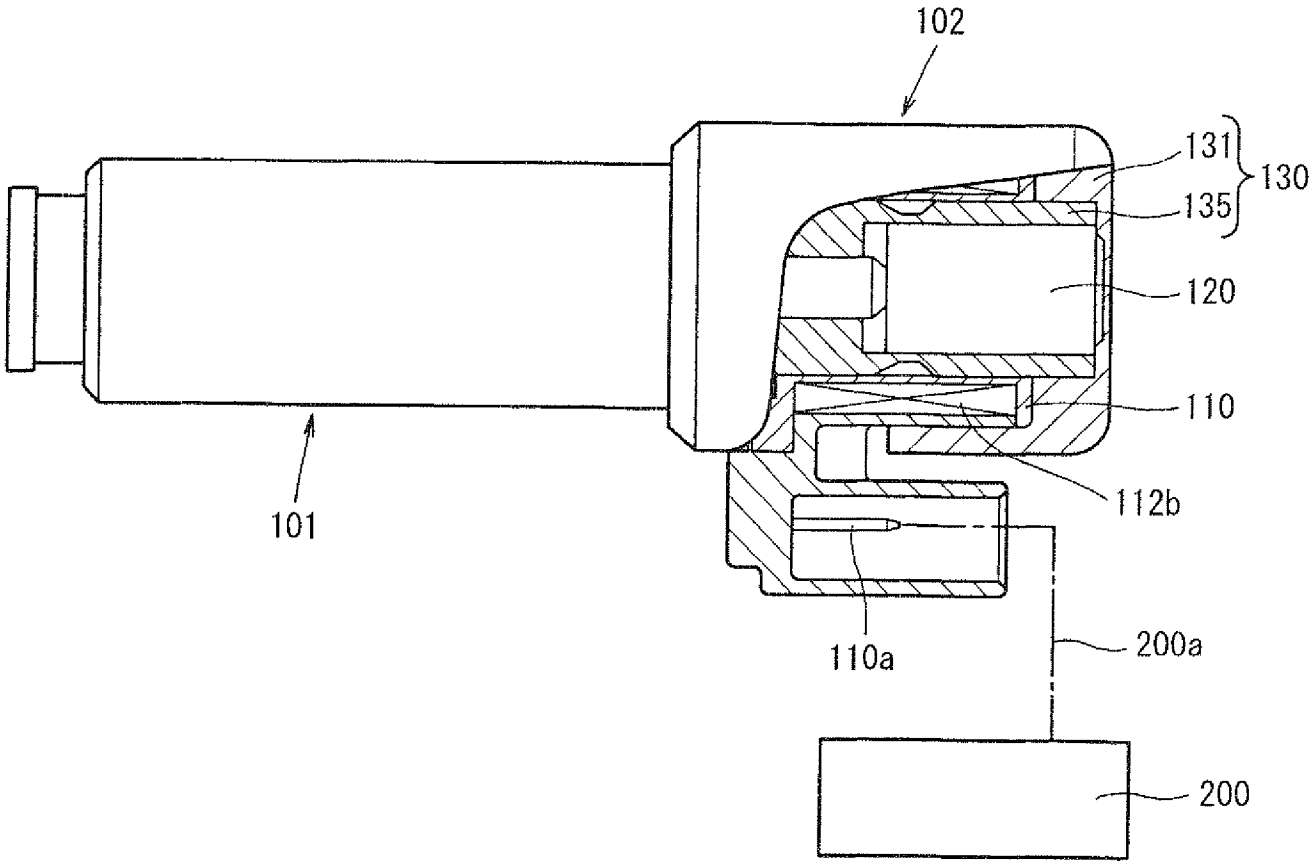
FIG. 9 PRIOR ART
FIG. 9 is a partially fragment view of a prior art solenoid hydraulic pressure control valve.

FIGS. 8A and 8B schematically show a main feature of a linear solenoid 2 according to a fifth embodiment of the present invention, seen from a rear side (the right side in FIG. 1) of the linear solenoid 2.

In the present embodiment, as the resiliently fixing means for fixing the coil device 10 and the magnetic stator 30 with each other through use of the resilient force, a plurality of projections 31*d* is integrally formed in a section of the outer peripheral surface of yoke 31, which is radially opposed to the inner peripheral surface of the guide 13 of the coil device 10, particularly the inner peripheral surface of the thick wall portion 13*b*. The projections 31*d* extend in the axial direction along the outer peripheral surface of the yoke 31. The projections 31*d* include two projections 31*d*, which are arranged one after another at an appropriate interval in the circumferential direction. Thereby, according to the present embodiment, the locations of the projections 31*d* are reversed with respect the projections 13*e* of the fourth embodiment. That is, the projections 31*d* are provided in the yoke 31 instead of the guide 13. The projections 31*d* serve as the resiliently fixing means.

Even in the present embodiment, similar to the fourth embodiment, a reaction force is exerted from the inner peripheral surface of the guide 13 of the coil device 10, particularly the inner peripheral surface of the thick wall portion 13*b* at the time when the projections 31*d* are urged against and bite into the inner peripheral surface of the guide 13. This reaction force, which is exerted from the inner peripheral surface of the guide 13, serves as the resilient force to implement the effect similar to that of the fourth embodiment.

Furthermore, in addition to or alternatively, the axially extending projections 31*d* may be integrally formed in another section of the outer peripheral surface of the yoke 31, which is radially opposed to the thin wall portion 13*a* of the guide 13, to utilize the resilient force of the thin wail portion 13*a*.

Additional advantages and modifications will readily occur to those skilled in the art. The invention in its broader terms is therefore not limited to the specific details, representative apparatus, and illustrative examples shown and described.

What is claimed is:

1. A linear solenoid for a vehicle, comprising:

a coil device that includes:

a coil main body that is configured into a tubular form and receives a solenoid coil therein; and a guide that projects from an outer peripheral surface of the coil main body and has a terminal, which is adapted to be connected with an external device to supply an electric power to the solenoid coil, wherein the coil device is entirely covered with resin except the terminal;

a plunger that is electromagnetically driven by the coil device; and a magnetic stator that forms a magnetic circuit to drive the plunger, wherein:

the coil device includes said terminal, which is configured into a strip, as the terminal, and the terminal, which is configured into the strip, is adapted to be directly connected to a terminal of the external device to form a rigid type connection therebetween;

the magnetic stator includes:

a stator core that receives the plunger in a slidable manner along an inner peripheral surface of the stator core, wherein the coil device is fitted to an outer peripheral surface of the stator core; and a yoke that is configured into a cup form and receives the stator core together with the coil device and has a slit, which extends from an opening end part toward a bottom part of the yoke to limit interference between the yoke and the guide;

resilient means for resiliently fixing the coil device and the magnetic stator with each other through use of a resilient force of the resin is provided at a location between the coil device and the magnetic stator;

the guide has a tongue portion, which is formed by the resin integrally with the guide at a location radially outward of the slit of the yoke and axially extends toward the opening end part of the yoke such that a distal end part of the tongue portion is resiliently bendable while exerting the resilient force;

the stator core has a flange portion, which is placed at the opening end part of the yoke and to which the tongue portion is adapted to be resiliently engaged; and the tongue portion is resiliently engaged with the flange portion upon the fitting of the coil device to the stator core to form the resilient means.

2. The linear solenoid for the vehicle according to claim 1, wherein the terminal, which is configured into the strip, has a bifurcated portion, which resiliently holds the terminal of the external device.

3. A linear solenoid for a vehicle, comprising:

a coil device that includes:

a coil main body that is configured into a tubular form and receives a solenoid coil therein; and a guide that projects from an outer peripheral surface of the coil main body and has a terminal, which is adapted to be connected with an external device to supply an electric power to the solenoid coil, wherein the coil device is entirely covered with resin except the terminal;

a plunger that is electromagnetically driven by the coil device; and a magnetic stator that forms a magnetic circuit to drive the plunger, wherein:

the magnetic stator includes:

a stator core that receives the plunger in a slidable manner along an inner peripheral surface of the stator core, wherein the coil device is fitted to an outer peripheral surface of the stator core; and a yoke that is configured into a cup form and receives the stator core together with the coil device and has a slit, which extends from an opening end part toward a bottom part of the yoke to limit interference between the yoke and the guide;

resilient means for resiliently fixing the coil device and the magnetic stator with each other through use of a resilient force of the resin is provided at a location between the coil device and the magnetic stator;

the guide includes an inner peripheral surface, which is exposed from the slit of the yoke to loosely fit to an outer peripheral surface of the yoke;

a projection, which extends axially, is formed by the resin integrally with the inner peripheral surface of the guide to engage with the outer peripheral surface of the yoke; and the guide is press fitted to the yoke with aid of the resilient force of the projection upon the fitting of the coil device to the stator core to form the resilient means.

4. A linear solenoid for a vehicle, comprising:

a coil device that includes:

a coil main body that is configured into a tubular form and receives a solenoid coil therein; and a guide that projects from an outer peripheral surface of the coil main body and has a terminal, which is adapted to be connected with an external device to supply an electric power to the solenoid coil, wherein the coil device is entirely covered with resin except the terminal;

a plunger that is electromagnetically driven by the coil device; and a magnetic stator that forms a magnetic circuit to drive the plunger, wherein:

the magnetic stator includes:

a stator core that receives the plunger in a slidable manner along an inner peripheral surface of the stator core, wherein the coil device is fitted to an outer peripheral surface of the stator core; and a yoke that is configured into a cup form and receives the stator core together with the coil device and has a slit, which extends from an opening end part toward a bottom part of the yoke to limit interference between the yoke and the guide;

resilient means for resiliently fixing the coil device and the magnetic stator with each other through use of a resilient force of the resin is provided at a location between the coil device and the magnetic stator;

the guide includes an inner peripheral surface, which is made of the resin and is exposed from the slit of the yoke to loosely fit to an outer peripheral surface of the yoke;

a projection, which is opposed to the inner peripheral surface of the guide, is formed integrally with the outer peripheral surface of the yoke; and the guide is press fitted to the yoke with aid of the resilient force of the resin against the projection upon the fitting of the coil device to the stator core to form the resilient means.

* * * * *